US005192595A

United States Patent [19]

Akeel et al.

[11] Patent Number: 5,192,595

[45] Date of Patent: Mar. 9, 1993

[54] METHOD FOR THE PRODUCTIVE UTILIZATION OF PAINT IN A PAINT SUPPLY LINE UTILIZING A CLEANING SLUG IN PRODUCTION PAINT OPERATIONS

[75] Inventors: Hadi A. Akeel, Rochester Hills; Alexander H. Joyce, Livonia, both of Mich.

[73] Assignee: GMFanuc Robotics Corporation, Auburn Hills, Mich.

[21] Appl. No.: 744,360

[22] Filed: Aug. 13, 1991

[51] Int. Cl.[5] ..... B05D 1/02; B05B 15/02

[52] U.S. Cl. ..... 427/421; 118/302; 15/3.5; 15/3.51; 134/22.11

[58] Field of Search ..... 427/421; 118/302, 408; 15/3.5, 3.51; 134/22.11

[56] References Cited

U.S. PATENT DOCUMENTS

| | | | |
|---|---|---|---|
| 1,806,270 | 5/1931 | Thompson | 15/3.5 |
| 3,348,774 | 10/1967 | Wiggins | 118/302 |
| 3,450,092 | 6/1969 | Kock | 118/302 |
| 3,562,014 | 2/1971 | Childers et al. | 134/22.11 |
| 4,113,890 | 9/1978 | Long | 15/3.5 |
| 4,416,703 | 11/1983 | Scott | 134/22.11 |
| 4,592,305 | 6/1986 | Scharfenberger | 118/302 |

*Primary Examiner*—Shrive Beck
*Assistant Examiner*—Katherine A. Bareford
*Attorney, Agent, or Firm*—Brooks & Kushman

[57] ABSTRACT

Method and system are provided for the productive utilization of paint in a paint supply line, changing paint colors and cleaning paint lines by inserting and propelling a termination piston or slug having an outer diameter which forms a sliding fit within the supply line to wipe pair off the interior walls of the supply line. Preferably, the supply line is elastic and the termination piston squeegees the paint off the interior walls. A manifold is fitted with various valves to selectively supply pressurized air, solvent and two or more paint colors to the supply line. A process controller controls the timing of the valves of the manifold. The method and system can also be used to retrofit existing color changers in an economical yet environmentally sound fashion.

5 Claims, 4 Drawing Sheets

METHOD FOR THE PRODUCTIVE UTILIZATION OF PAINT IN A PAINT SUPPLY LINE UTILIZING A CLEANING SLUG IN PRODUCTION PAINT OPERATIONS

CROSS-REFERENCE TO RELATED APPLICATION

This application is related to U.S. patent application Ser. No. 07/744,361 ENTITLED "Method And System For Cleaning A Paint Supply Line And Changing Paint Colors In Production Paint Operations" filed on the same day as this application and having the same assignee.

TECHNICAL FIELD

This invention relates to method and system for the productive utilization of paint in a paint supply line, changing paint colors, and cleaning paint lines, and in particular, to method and system for the productive utilization of paint in a paint supply line, changing paint colors and cleaning the paint lines in production paint operations

BACKGROUND ART

High volume production paint operations require the changing of colors for successively painted products. For example, in an automotive production plant, car bodies are scheduled for production in an order influenced by many factors, where color is only one of such factors. As the bodies enter the paint booth, the paint equipment are set by their controllers to paint the required colors. Colors may be changed as often as for each successive car body entering the paint booth, or, the car bodies may be sequenced such that as many successive cars as possible are painted with the same color.

When colors are changed, the paint line extending from the paint color changer to the spray nozzle is thoroughly cleaned with paint solvent before the new color is introduced to fill the line to the nozzle. Since the paint in the lines cannot be fully utilized, much paint is wasted with every color change. This is a costly and environmentally sensitive process and is highly critical that its frequency and waste be minimized.

Usually the sequence of changing colors is as follows:

1. When color change is due, the current color valve is turned OFF at an interval, Ts, before shutting off the spray. Ts is calculated to allow most of the paint remaining in the delivery line to be use productively before the line is cleaned.
2. A low pressure air, (i.e. "soft air"), valve is turned on to push the current color paint with air, having a pressure equal to the paint pressure, and use the paint in the line for productive painting. After an interval, Ts, the object of the painting is fully painted and the spray nozzle, (i.e. spray gun), is turned OFF. Some paint remains in the line and the internal line walls are usually covered with a layer of unused paint.
3. The paint delivery line is then cleaned by turning the purge cycle on. This opens an excess paint return line to a dump tank, inject solvent, or successive bursts of solvent and high pressure air, into the line and the spray nozzle, and dumps the solvent and air into the dump tank until the line is clear.

4. The line is filled with the new color paint, pushing out any excess solvent through the nozzle or to the dump tank.

Variations of this cycle exist to minimize the time required to empty and clean the line, or to minimize the wasted paint and solvent used in the process.

A typical prior art color changer is represented diagrammatically in FIG. 1.

A series of pneumatically operated two-position valves 10, 12, 14 and 16 communicate solvent source lines and paint source lines 18, 20, 22 and 24 respectively, to a common manifold, generally indicated at 26. The paint valves include return circulation lines 28, 30 and 32 which allow the paint to flow continuously back to central storage tanks regardless of paint utilization. This prevents pain pigments from settling and causing uneven paint coloring. Air lines 34 and 36 also communicate low and high pressure air, respectively, to the terminal end of the common manifold.

The manifold 26 is also communicated through the tubing of a paint delivery line 38 to a spray gun/nozzle 40. The spray gun 40 may also be fitted with a dump valve 42 and a return line 44 that allow excess paint and cleaning fluids to be returned to a dump tank 46.

Control signals, such as on lines 48, 50 and 52, allow a central programmable controller 54 to actuate any of the paint, solvent, air or spray gun actuation valves to effect the desired paint flow, paint changing, and line cleaning operations.

The method of prior art color change is represented in FIG. 2, with a flow chart. Its sequence is described by explaining the blocks of the flow chart.

At block 56, the sequence starts with a clear line. At the beginning of a shift, this is the prevailing condition as the line would have been cleaned at the end of the prior shift.

At block 58, the desired paint color valve is turned ON to pass the desired color paint in the paint delivery line 38. The dump valve 42 and/or the gun nozzle 40 is turned ON to relieve the pressure ahead of the flow of paint. The paint flows from one of the valves 12, 14 through 16 of FIG. 1 through the manifold 26 through the paint delivery line 38 to the spray gun 40 or the dump valve 42 for excess recovery. When an estimated amount of paint has flown through the desired valve, estimated by metered timing of the flow, the spray gun 40 and the dump valve 42 are turned OFF and the system is ready for productive painting with the desired color.

At block 60, with the line 38 filled, the dump valve 42 is turned OFF and the object may be sprayed by turning the gun 40 ON and OFF as necessary.

At block 62, color change is usually commanded by the programmable controller 54 of FIG. 1 ahead of the desired timing of productive painting with the current paint color. This allows the paint filling the delivery line 38 to be utilized. If color change is not due, the current paint continues to be used.

At block 64, when color change is due, the paint delivery line is cleared of the current paint. The current valve is then turned OFF to stop the flow of the current paint, and, simultaneously, a low pressure air valve 65 is turned ON for soft air push-out. Air pressure is usually the same as the paint line pressure, hence allowing continuity in the flow rate of the paint through the nozzle 40.

At block 66, when the paint object is fully painted, the flow of soft air is stopped. This is usually timed to leave some paint in the line 38 which is not utilized.

At block 68, the excess paint is recovered by turning the dump valve 42 ON and a high pressure air valve 69 ON.

At block 70, line 38 is then cleaned by sequencing the alternate opening and closing of hard air and solvent valves 69 and 70, respectively, while the dump valve 42 is ON. This sequence sends slugs of solvent through the line 38 at high speed which is effective in cleaning. After a predetermined period, determined by experiment, the line 38 is assumed clean and ready for filling by the new color.

At block 72, with the line 38 clean, the nozzle 40 is cleared by turning the gun 40 ON, and passing high pressure air, carrying solvent from the line 38 through the nozzle 40.

At block 74, if it is the end of the shift, the system is stopped with the line 38 and nozzle 40 clear and ready for the next shift, otherwise the cycle is repeated and the line 38 is filled with the new color.

Variations of this method exist. For example, U.S Pat. No. 4,902,352 discloses a paint color change system in which the paint flow passage of the paint supply line leading to a paint atomizer is cleaned using a scrubbing medium comprising a high-pressure air containing an atomized solvent. An attempt to parallel two delivery lines so one can be cleaned while the other is being utilized for productive painting is disclosed in U.S. Pat. No. 4,487,367.

U.S. Pat. Nos. 3,108,012 to Curtis; 3,432,383 to Russell; 3,562,014 to Childers et al; 4,418,747 to Baron et al; and 4,898,197 to Barry et al disclose a variety of differently configured slugs used for cleaning various types of rigid hollow tubing, pipeline and the like.

U.S. Pat. Nos. 4,508,266 to Saito et al; 4,657,047 to Kolibas; 4,700,896 to Takeuchi et al; 4,846,226 to Merritt; and 4,909,180 to Oishi et al disclose various types of color changers for paint systems generally related to the present invention.

The prior art color change methods share one or more serious shortcomings. For example, it has been shown that for the commonly used high-solids paint, almost 40% of the paint in the line adheres to the walls of the tubing and is not used for productive painting. In some applications having long paint lines, this represents a large percentage (i.e. 20%–40%) of the paint consumed in production. Much is wasted in addition to the loss of this paint. The cost of cleaning the paint with solvents, recovering the paint and the cleaning solvents for environmental protection, and in finding means for environmentally safe waste dumping for recovery is high.

Also, the time needed for cleaning the line and refilling it is a time lost of the productive time of the paint equipment and facilities. Since in a typical automotive assembly plant this time could amount to 15 seconds of each minute available for production, the paint equipment could lose as much as 25% of its productive capacity. This includes the large investment made in human resources, paint booths, robots, paint circulation and spray equipment, ovens, conveyors, etc.

Finally, the equipment used to improve the performance of color changers involves the use of a multiplicity of valves and control devices which are complex, costly, and prone to failure. Paint leaks and control failures are common occurrences in such systems.

SUMMARY OF THE INVENTION

It is an object of the present invention to provide a method and system for the productive utilization of paint and cleaning paint supply lines in high volume production painting operations which: minimize the paint wasted with each color change; minimize the time required for cleaning the supply lines prior to changing colors; and are environmentally friendly and use a minimum of solvents in cleaning the paint lines.

In carrying out the above object and other objects of the present invention, a method is provided for the productive utilization of substantially all of the paint in a paint supply line. The interior walls of the supply line have a substantially constant inside diameter. The method includes the steps of inserting a termination piston within the supply line, and propelling the termination piston through the supply line so as to cause the termination piston to push the paint through the supply line for the productive use of the paint as the termination piston wipes the paint off the walls of the supply line by virtue of the close sliding fit of the termination piston within the supply line thus leaving the walls of the supply line virtually free of any residue paint. Finally, the method includes the step of removing the termination piston from the supply line after the step of propelling.

Further in carrying out the above object and other objects of the present invention a method is provided for changing paint colors and cleaning a paint supply line in a paint system. The paint system includes applicator means being fed with paint by the supply line, a first source of pressurized paint of a first color and a second source of pressurized paint of a second color adapted to be selectively connected to the supply line. The interior walls of the supply line have a substantially constant inside diameter. The method includes the step of connecting the supply line to the first source of pressurized paint to fill the supply line with the first color paint to allow the applicator means to paint an article. The method also includes the step of disconnecting the supply line from the first source of pressurized paint when the remaining paint in the supply line is sufficient to complete the painting of the article, and feeding the remaining paint in the supply line to the applicator means until essentially no paint of the first color remains in the supply line. The method includes the step of inserting a termination piston having an exterior surface with an outside diameter which forms a close sliding fit within the supply line after the step of disconnecting. The method further includes the step of propelling the termination piston through the supply line so as to cause the surface of the termination piston to wipe paint off the interior walls of the supply line by virtue of the termination piston being propelled through the supply line. The method further includes the step of removing the termination piston from the supply line after the step of propelling and connecting the supply line to the second source of paint so as to fill the supply line with the second color paint to allow the applicator means to again paint an article.

Preferably, the supply line is elastic and the termination piston squeegees the paint off the interior walls.

A system and apparatus are provided for carrying out each of the method steps.

The above object and other objects, features, and advantages of the present invention are readily apparent from the following detailed description of the best mode for carrying out the invention when taken in connection with the accompanying drawings.

BEST MODE FOR CARRYING OUT THE INVENTION

In general, the method of the present invention is a process for the productive utilization of paint in a paint supply line and for cleaning paint lines in high volume production paint operations. Specifically, the method is an approach for clearing the paint lines from one paint color to another, without waste, and for cleaning the lines, thus improving the economics of operation and reducing hazardous waste emissions.

The method of the invention includes a number of steps. Initially, the flow of a particular paint color "the current paint" is terminated by shutting off its flow valve at a paint source manifold.

Then, a slidably fitted "termination piston or slug" is inserted into the paint line at the trailing end of the current paint column. The slug is preferably chosen to be a low friction material and is closely and slidably fitted inside the flexible paint tubing. The slug is formed to scrape or squeeze paint off the walls of the paint delivery line.

The slug is then pushed through the paint line thereby pushing the paint ahead of it. Preferably, the slug is pushed by pressurized air.

The above steps of the method are initiated substantially simultaneously.

The air flow is terminated when the paint in the paint line is utilized as fully as practical.

Then the slug and any excess paint are disposed of by placing into collection containers.

Then the supply line is cleaned utilizing alternating "shots" of solvent and pressurized air.

Finally, the supply line is filled with the new paint.

Figure 1:
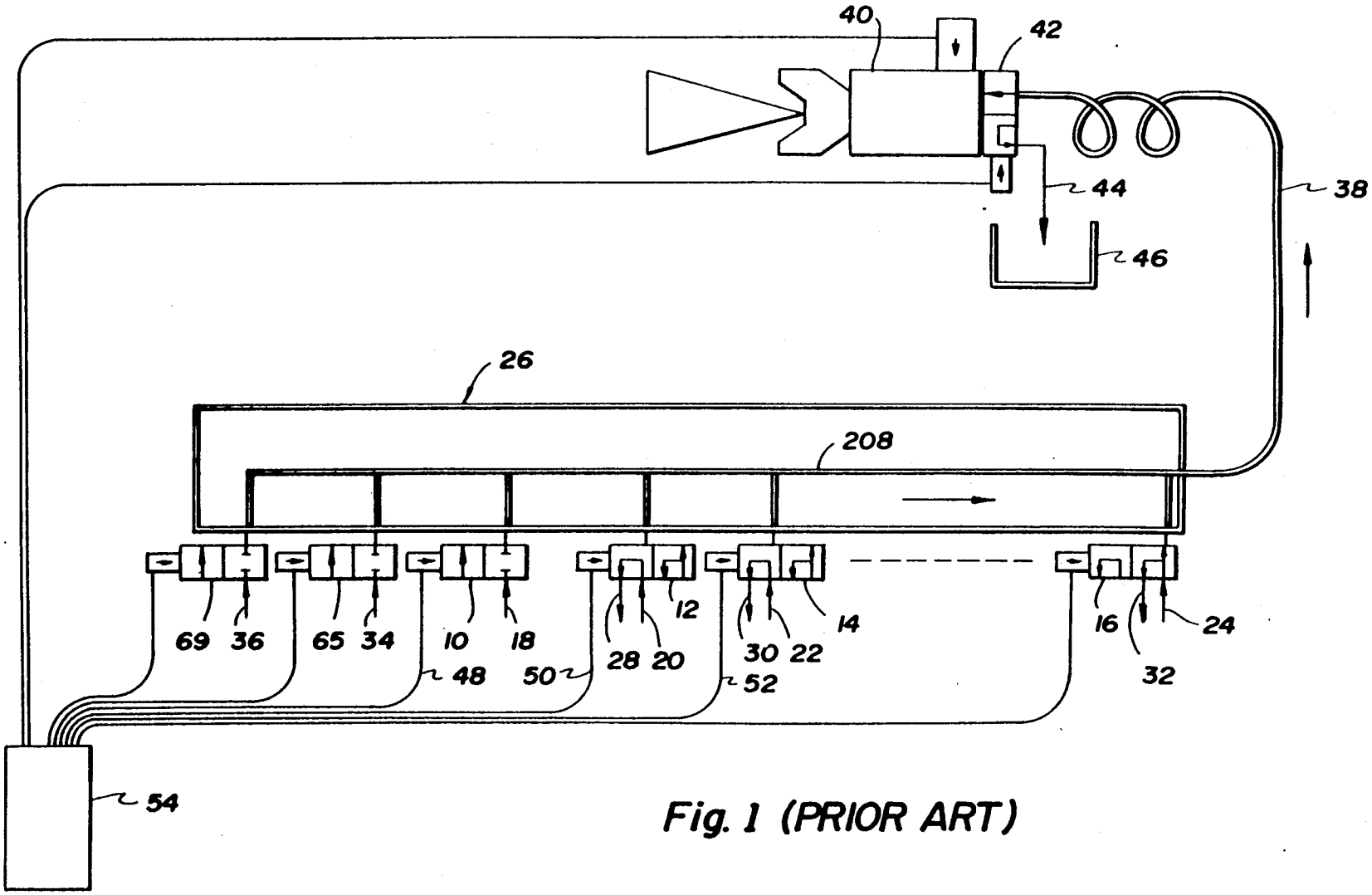
Fig. 1 (PRIOR ART)
FIG. 1 is a diagrammatical illustration of a conventional prior art color changer.
Figure 3:
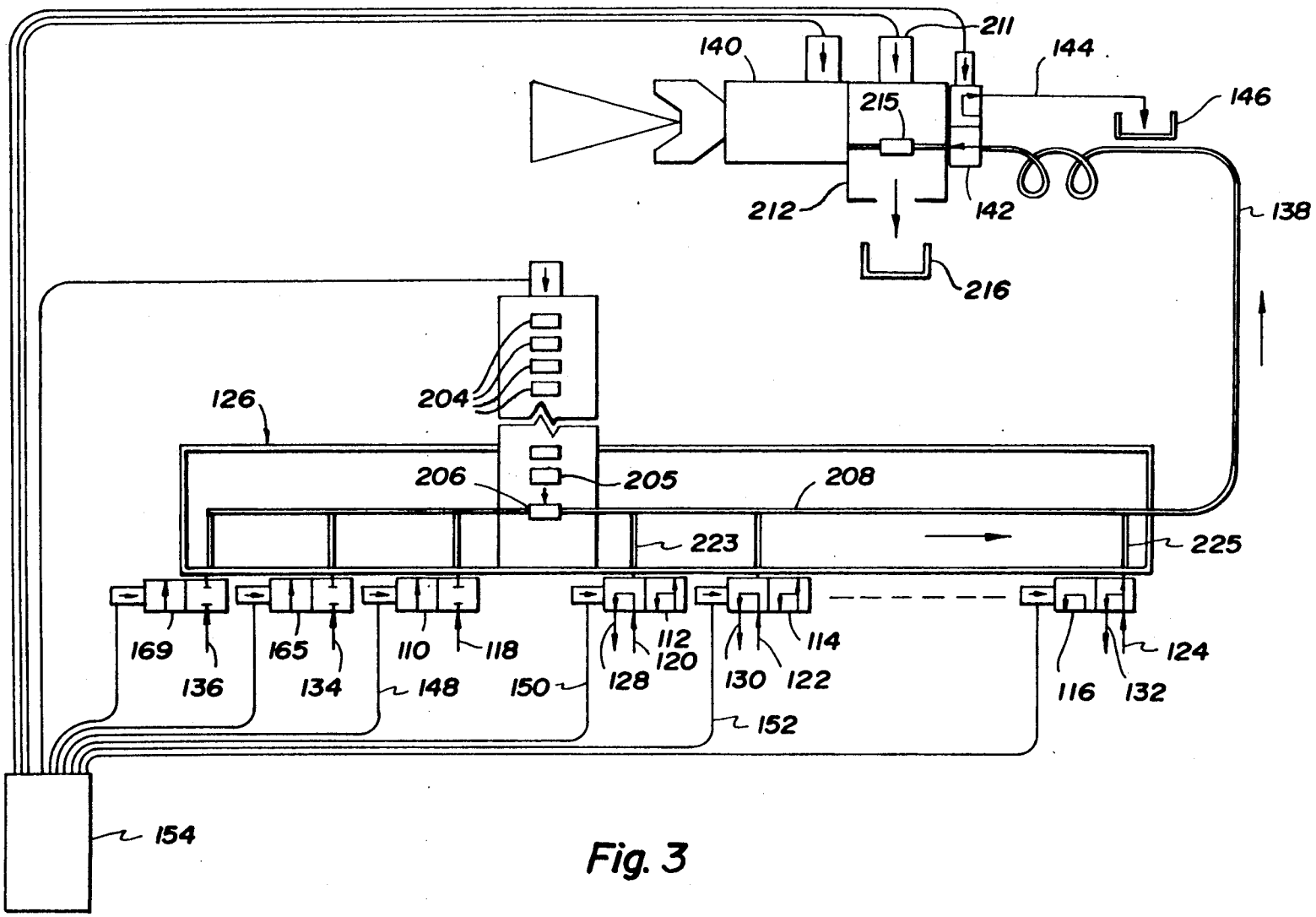
FIG. 3 is a diagrammatical illustration of the apparatus and system of the present invention which is a modification of the prior art apparatus of FIG. 1.

Referring now to FIG. 3, the apparatus and system of the invention is specifically shown. The parts illustrated in FIG. 3, which are the same or similar to the parts of FIG. 1, have "100" added to their numerical designations.

Referring to FIG. 3, a manifold generally indicated at 126 is fitted with paint color change valves 112 and 116, a solvent ON/OFF valve 110, a low pressure air valve 165 and a high pressure air valve 169. Inserted between one terminal paint valve 112 and the solvent valve 110 is a slug injector assembly or device, generally indicated at 200. The slug injector assembly 200 stores a plurality of slugs 204. The injector assembly 200 includes an injection mechanism, such as a piston (not shown), operated by a pilot operational valve 202 to move one slug 204 at a time from a storage position 205 to an insertion position 206.

When at the insertion position 206, the slug is inserted or injected in a common passage 208 in the manifold 126 through which all fluids, paint, solvent and air, flow to the spray nozzle 140 by means of a paint delivery or supply line or tube 138. The paint tube 138 attaches to slug ejector assembly or device 212 in close proximity, and preferably integral to the spray gun 140.

The ejector assembly 212 is fitted with an ON/OFF air valve 211 which introduces pressurized air to push a slug at position 215 into a slug collection container.

A dump valve 142 is attached between the ejector assembly 212 and the spray gun 140 to divert excess paint and cleaning solvent into a collection tank 146. All valve actuators are operated through communication lines by a common programmable controller 154.

METHOD OF OPERATION

Figure 2:
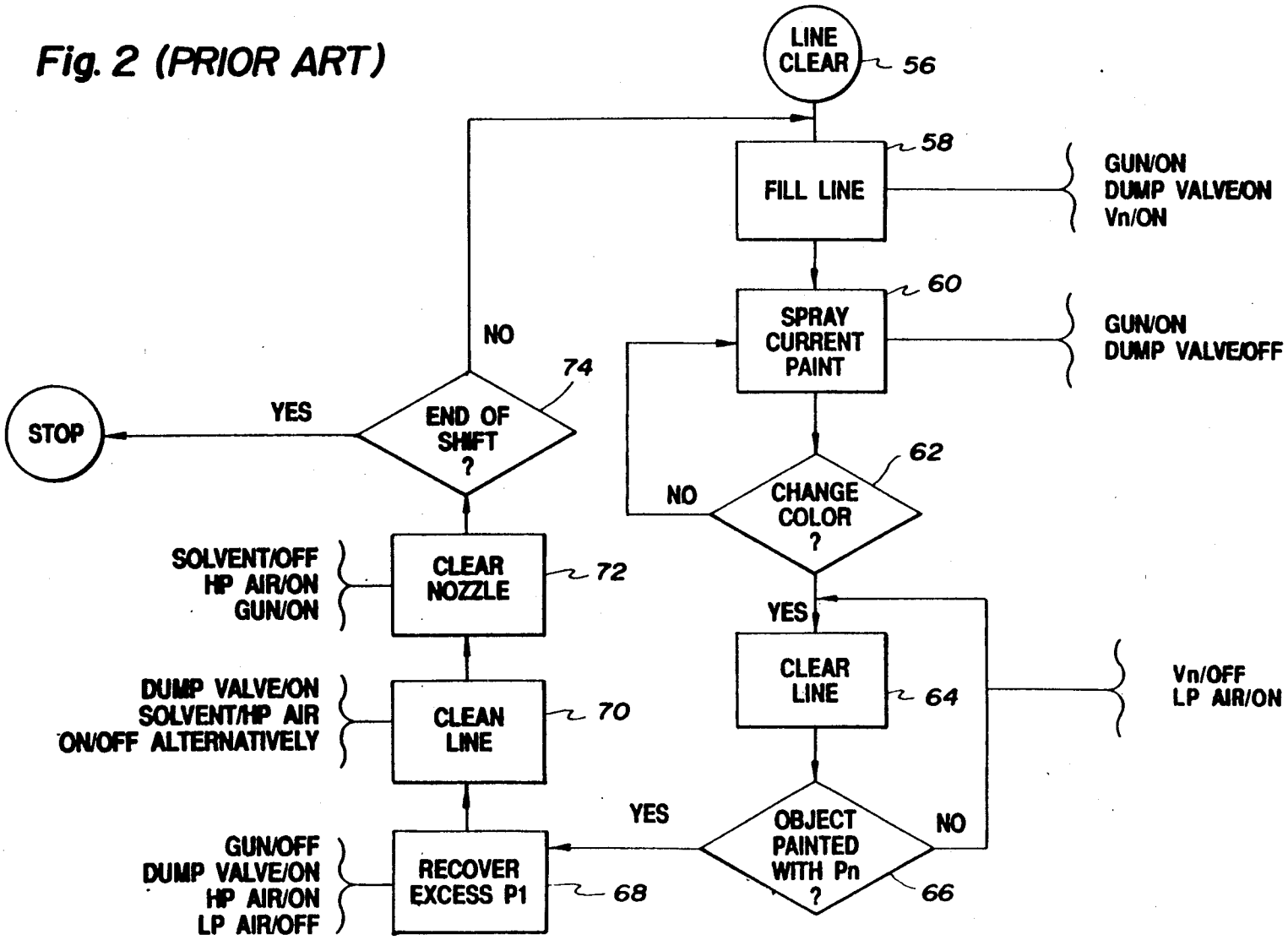
Fig. 2 (PRIOR ART)
FIG. 2 is a flow chart block diagram illustrating the method steps performed by the color changer of FIG. 1.
Figure 4:
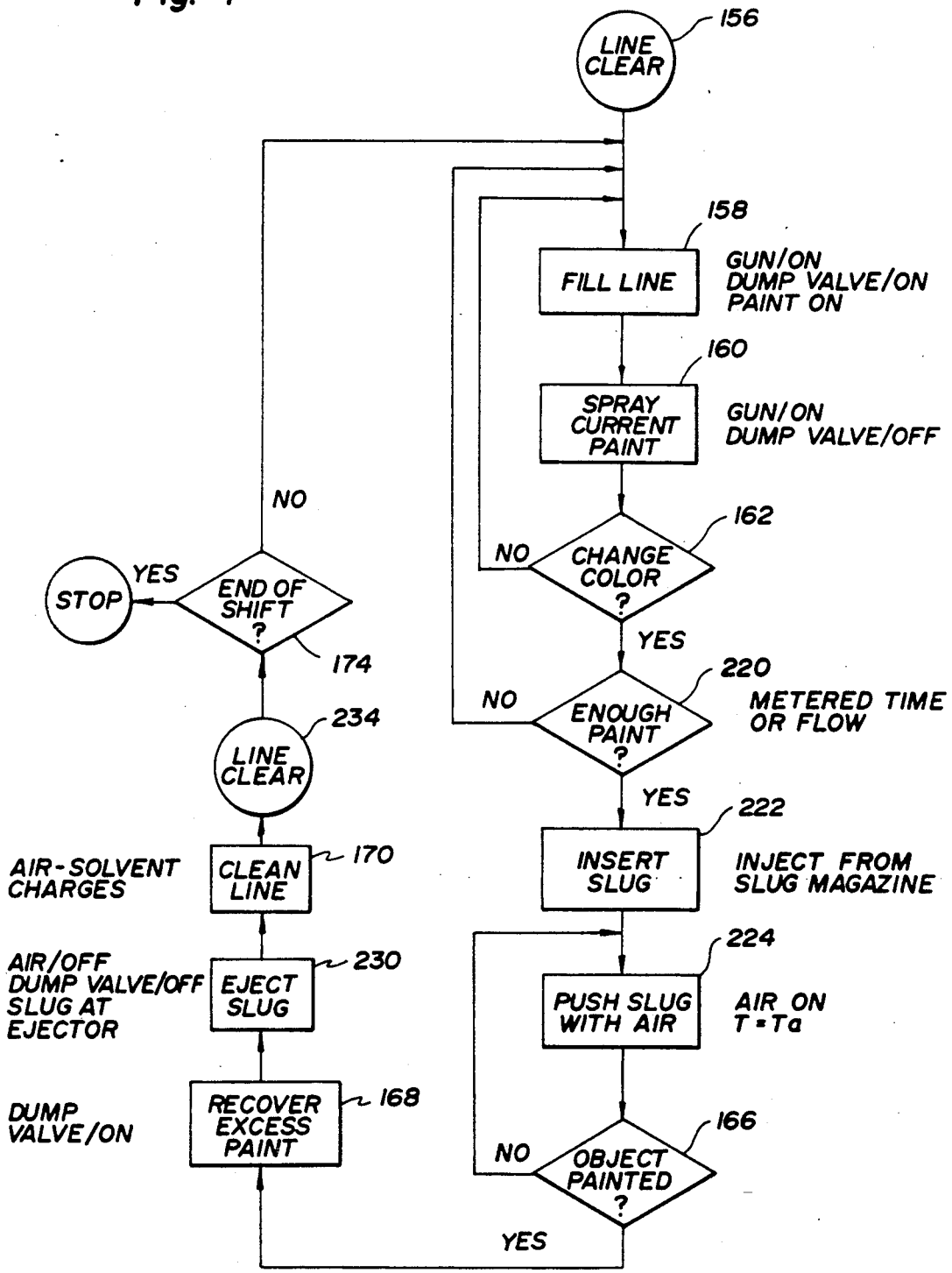
FIG. 4 is a block flow diagram illustrating the method steps performed by the apparatus and system of FIG. 3.

The method of operation according to the invention is described with reference to the event blocks of the flow chart of FIG. 4 and with reference to FIG. 3. Blocks in FIG. 4 similar to the blocks of FIG. 2 have the number "100" added to their numerical designation.

At block 156, at the start of an operation, the paint delivery line 138 is usually clear and ready to deliver paint. The system is also assumed to have been initialized by loading the slug injector assembly 200 with a number of slugs 204 as necessary to operate without interruption to the next regular production step, e.g. end of shift or lunch break. The slugs 204 may be prestacked into a magazine which can then be loaded into the injector assembly 200. The injector assembly 200 is designed to inject one slug at a time into the manifold 126 in any manner customarily used with automatic loading mechanisms. An example is described in the above-noted application.

At block 158, starting with a clear paint delivery line 138, the valve 112 or the valve 116 or any valve in between of the desired paint color is turned ON [Pn/ON]to allow the paint to flow through the manifold passage 208 and fill the paint delivery line 138 to the nozzle 140 and the dump valve 142. Either one or both of gun 140 and the dump valve 142 may be turned ON [dump valve/ON], [gun/ON]to allow air to escape ahead of the paint that flows into the supply line 138. This relieves pressure ahead of the paint, thus allowing the paint to flow at maximum speed through the supply line 138.

After a time, (i.e. interval premeasured to match the completion of the filling of the supply line 138 under known paint line pressure), the gun 140 or the dump valve 142 is turned OFF. The paint is then ready at the gun 140 for productive spraying.

At block 160, assuming that the object of painting is in position and ready for painting and the dump valve 142 is OFF, the gun 140 is turned ON [gun/ON] to allow the paint to flow from the opened source valve 112 or valve 116 through the spray nozzle 140.

At block 162, the programmable controller 154 is usually programmed to monitor the need for a color change according to production schedules of the paint operation. When needed, the controller 154 initiates a color change, otherwise current paint continues to be sprayed on successive objects.

At block 220, if a color change is required, the controller 154 monitors the flow of the current paint in the supply line 138 (metered time or flow) and continues to fill the supply line 138 with the current paint.

At block 222, when the amount of paint that fills the supply line 138 is enough to finish painting the current production job, the controller 154 sends a signal to the injector device 200 to insert a slug into the manifold passage 208 [Inject from slug magazine]. The slug is provided to terminate the column of current paint that fills the supply line 38 and the passage 208.

At block 224, substantially simultaneously with the insertion of the slug into the manifold passage 208, pressurized air valve 165 or valve 169 is turned on [AIR-/ON]thus allowing air to push the slug and the column of paint ahead of it out of the manifold 126 and through the supply line 138. This operation is timed to end after a time interval, Ta [T=Ta], which is predetermined adequate to move the paint through the supply line 138 and utilize it as fully as practical in production painting at the prevailing paint flow rate.

For systems set to a common paint pressure for all colors, the valve 165 is used and set to supply air (i.e. soft air) at the common paint pressure so as not to disturb the flow of the current paint. For systems having a common paint pressure regulator located at the spray gun, high pressure air from the valve 169 may be used and the valve 165 is eliminated.

At block 166, the controller 154 checks for completion of object painting. The timing of the process allows the slug to flow to the vicinity of the spray gun 140 leaving a small amount of paint in the supply line 138. The excess paint assures that the system does not run out of paint before the current job is fully painted. When completed, the controller 154 initiates the recovery of the excess paint.

At block 168, with the gun 140 OFF, the dump valve 142 ON and the air valve 165 or valve 169 ON [AIR-/ON], the remaining portion of the current paint flows into the recovery tank 146 via a dump line 144 and the slug reaches the ejector assembly 212.

At block 230, once the slug is inside the ejector assembly 212, at the position 215, the controller 154 actuates the valve 211 to eject the slug into the disposal container 216. The disposal container 216 can be the same as the excess paint tank 146 or may be a separate container. The paint delivery device, such as a robot or an automatic reciprocator, may be moved to allow the ejector assembly 212 access to the disposal container.

At block 170, the line 138 is cleaned in a conventional manner by alternating the opening and closing of the solvent valve 110 and the pressurized air valve 169 to pass charges of solvent and air [AIR-SOLVENT CHARGES] into the line 138 which is a proven effective way for cleaning. Because the use of a slug virtually pushes all the paint ahead of it, the line 138 is wiped much cleaner than with prior art and much less solvent and air is used for cleaning. In addition, the time to clean the line is appreciably reduced.

At block 234, after the line 138 has been cleaned, the line 138 is clear of any paint and is ready for a new cycle.

At block 174, if at the end of the shift, the controller 154 stops the operation with the apparatus ready for a new shift with the line 138 empty, per the step of block 234. If not at the end of a shift, the controller 154 initiates the filling of the line with the new desired color and the system is then ready for a new cycle when a new object is positioned for painting.

While the best mode for carrying out the invention has been described in detail, those familiar with the art to which this invention relates will recognize various alternative designs and embodiments for practicing the invention as defined by the following claims.

What is claimed is:

1. A method for changing paint colors, cleaning and productively utilizing paint in a paint supply line in a paint system, the system having applicator means being fed with paint by the supply line, a first source of pressurized paint of a first color, a second source of pressurized paint of a second color, a source of pressurized air and a source of cleaning fluid adapted to be selectively connected to the supply line, interior walls of the supply line having a substantially constant inside diameter, the method comprising the steps of:

connecting the supply line to the first source of pressurized paint to fill the supply line with the first color paint to allow the applicator means to paint an article;

disconnecting the supply line form the first source of pressurized paint when the remaining paint in the supply line is sufficient to complete the painting of the article;

inserting a termination piston having an exterior surface with an outside diameter which forms a close sliding fit within the supply line after the step of disconnecting;

propelling the termination piston through the supply line so as to cause the termination piston to wipe paint off the interior walls of the supply line by virtue of the termination piston being propelled through the supply line, thus feeding the paint in the supply line to the applicator means until essentially no paint of the first color remains in the supply line;

removing the termination piston from the supply line after the step of propelling, then alternating the connection of the supply line between the source of pressurized air and the source of cleaning fluid to cause charges of cleaning fluid to be propelled through the supply line at a speed sufficient to cause the walls of the supply line to be washed clean of substantially all traces of paint of the first color; and connecting the supply line to the second source of paint so as to fill the supply line with the second color paint to allow said applicator means to again paint an article.

2. The method of claim 1, further comprising the step of depositing at least a portion of the removed paint into the paint sump by virtue of the termination piston being propelled through the supply line.

3. The method of claim 1, wherein the surface of the termination piston is made from a low friction material.

4. The method of claim 1, further comprising the step of connecting the supply line to a source of pressurized air to propel the termination piston through the supply line.

5. The method of claim 1, wherein the supply line is elastic and wherein the termination piston squeegees the paint off the interior walls of the supply line by virtue of the elasticity of the supply line.

* * * * *